United States Patent [19]

Knepp

[11] 4,063,615

[45] Dec. 20, 1977

[54] ESCAPE DEVICE

[76] Inventor: Donald E. Knepp, 1343 E. Bowman, South Bend, Ind. 46613

[21] Appl. No.: 642,181

[22] Filed: Dec. 18, 1975

[51] Int. Cl.[2] ..... B66D 5/04

[52] U.S. Cl. ..... 182/5; 254/157

[58] Field of Search ..... 182/5, 6, 7, 191, 192, 182/193, 73, 74, 75; 254/157, 154

[56] References Cited

U.S. PATENT DOCUMENTS

| | | | |
|---|---|---|---|
| 285,319 | 9/1883 | Stofflet | 254/159 |
| 751,361 | 2/1904 | Van Gent | 254/154 |
| 940,601 | 11/1909 | Jahnke | 254/157 |
| 1,098,223 | 5/1914 | Brown | 182/6 |
| 2,205,026 | 6/1940 | Barham | 254/154 |
| 2,569,597 | 10/1951 | Bailey | 254/154 |
| 3,915,432 | 10/1975 | Bustamante | 254/157 |
| 4,000,881 | 1/1977 | Matsumoto | 254/157 |

*Primary Examiner*—Reinaldo P. Machado
*Attorney, Agent, or Firm*—Oltsch & Knoblock

[57] ABSTRACT

An escape device which includes a housing from which the user of the device is supported. The housing journals a drum about which a cable is coiled. During use of the device the free end of the cable is secured to a building part while the user being supported by the housing descends to the ground. A braking mechanism is incorporated in the housing to regulate the rate of descent of the housing and supported user.

4 Claims, 5 Drawing Figures

ESCAPE DEVICE

SUMMARY OF THE INVENTION

This invention relates to an escape device and will have particular application to an improved fire escape device by which a building occupant can safely descend from a window or roof of the building to the ground during a fire or similar emergency .

The escape device of this invention includes a housing journaling a drum. A cable is coiled about the drum. The free end of the cable is adapted to be connected to a building structure part. A harness or similar body support means is connected to the escape device housing. As the device user while carried within the support means descends to the ground from a window or roof with the free end of the cable attached to a building structure part, his rate of descent can be slowed through a brake mechanism incorporated in the escape device housing.

Accordingly, it is an object of this invention to provide a device by which a person can escape from an upper story window or roof during a fire.

Another object of this invention is to provide a fire escape device which is of a compact, portable construction and which is of reliable and simplified operation.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

Figure 1:
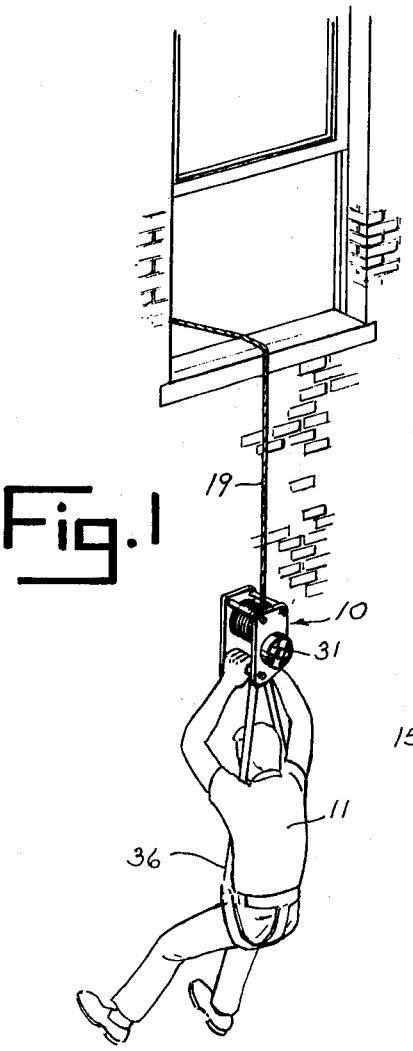
FIG. 1 is a view of the escape device being utilized.
Figure 2:
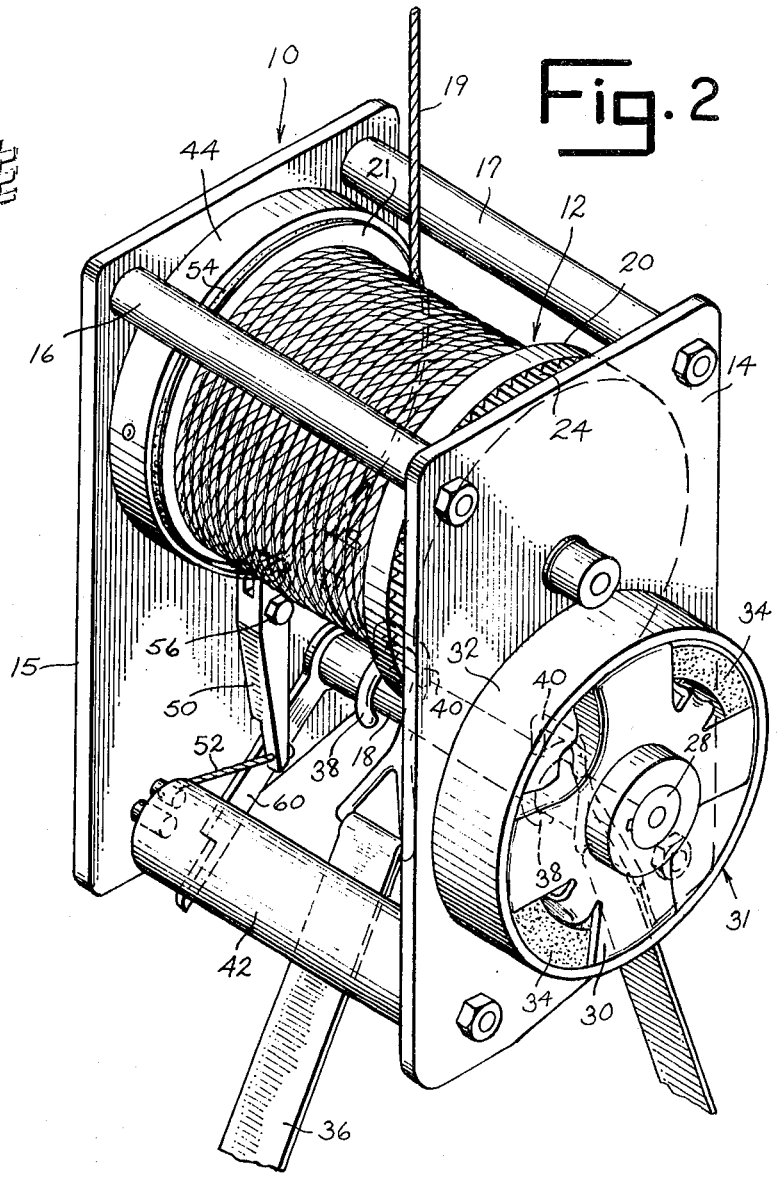
FIG. 2 is a perspective view of the housing portion of the escape device.
Figure 3:
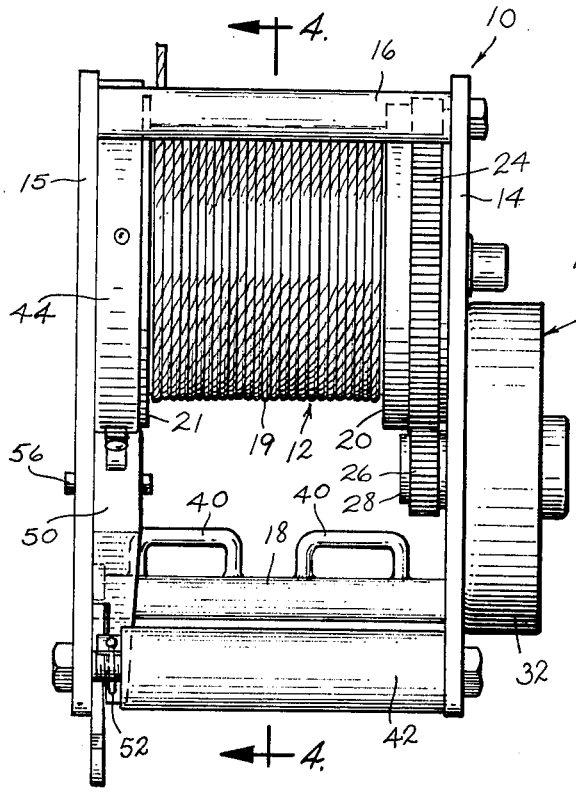
FIG. 3 is an end view of the housing portion of the escape device.

The preferred embodiment illustrated is not intended to be exhaustive or to limit the invention to the precise form disclosed. It has been chosen and described in order to best explain the principles of the invention and its application and practical use to thereby enable others skilled in the art to best utilize the invention.

The escape device of this invention includes a housing 10 journaling a drum 12. Housing 10 includes side plates 14 and 15 secured together by cross bar members 16, 17 and 18. A cable 19, preferably formed of wire, is coiled about drum 12 between its end flanges 20 and 21. One end of cable 19 is secured to drum 12 and its opposite or free end is provided with a hook 22. Cable 19 may be several hundred feet in length, depending upon the maximum height at which the escape device of this invention is to be utilized.

Side flange 20 of drum 12 is formed into a gear wheel 24. Gear wheel 24 meshes with a pinion type gear 26 which is secured upon a shaft 28. Shaft 28 extends through the adjacent housing side plate 14 and is secured to a rotor 30 of a centrifugal brake or govenor 31. Governor rotor 30 fits within a cylindrical braking member 32 which is secured against rotation to side plate 14. Rotor 30 carries a plurality of radially shiftable friction pads 34. Upon rotation of drum 12 intermeshing wheel 24 and pinion 26 cause the rotation of shaft 28 and rotor 30. A As rotor 30 rotates, pads 34 are urged radially outwardly by centrifugal force against braking member 32. This causes a braking action which governs the maximum speed by which cable 19 uncoils from about drum 12 upon the descent of housing 10 while supporting a user 11, as illustrated in FIG. 1. The precise construction of the governor for drum 12 can vary and may assume the configuration of any of a variety of commercially available friction braking devices.

A harness 36, which is adapted to support the user of the escape device, is secured by hooks 38 to cross bar member 18. Hooks 38 are anchored against lateral movement along cross bar member 18 by being inserted through eyelets 40 welded to the cross bar member. The precise type and form of harness 36 can vary from construction to construction of the escape device. In some constructions of this device it may be desirable to incorporate the harness into a chair.

Housing 10 also carries a hand actuated braking device for the purpose of selectively regulating the rate of descent of housing 10 when supporting the device user. This braking device is preferably used in association with the governor 31 which regulates the maximum rotational speed of drum 12. The hand braking device includes a handle 42 which extends between housing side plates 14 and 15 and which is journaled for rotative movement in the side plates about an axis of rotation 43 which generally parallels the axis of rotation 63 of drum 12. Flange 21 of drum 12 is formed into an annular smooth braking surface about which an elongated band 44 is located. One end 46 of band 44 is adjustably anchored to side plate 15. The opposite end 48 of the band is connected to one end of a lever 50. Lever 50 is pivotally connected intermediate its ends to side plate 15. The opposite end of lever 50 is connected by a flexible wire connector 52 to handle 42. A lining 54 of brake material is carried by band 44 and is positioned between the band and the braking surface of drum flange 21. The connection of wire connector 52 to lever 50 is offset from the lever's axis of rotation so that upon turning of handle 42 in either direction wire connector 52 will be drawn around the handle. This serves to draw the end portion of lever 50 to which wire connector 52 is connected toward the handle with a resulting constrictive tightening of band 44 and brake lining 54 about the braking surface of drum flange 21. A mechanical advantage is provided for the tightening of band 44 about drum flange 21 by positioning the pivot connecting bolt 56 of lever 50 closer to the end of the lever to which end 48 of the band is connected than to the end of the lever to which wire connector 52 is connected. It is to be understood that regardless of which direction handle 42 is rotated by the user of the escape device band 44 is caused to be tightened about flange 21 of drum 12 to selectively reduce and control the rate of the descent of housing 10 and the escape device user. Adjustment of the braking device can be effected by means of an adjustment screw 58 utilized to secure end 46 of the band to housing side plate 15.

A pin 60 is pivotally connected at one end to cross bar member 18. The free end of pin 60 interlocks with handle 42 when the handle is rotated to the left as viewed in FIGS. 4 and 5 with band 44 tightening about side flange 21 of drum 21. In this manner pin 60 serves as a lock which when engaging rotated handle 42 prevents coiled cable 19 from becoming unintentionally unwound from the drum.

To utilize the escape device above described, the user secures the free end of cable 19 by way of hook 22 about a fixed structural part of the window or room. The user then seats himself within harness 36, climbs out the window, unlocks drum 12 by the further rotation of handle 42 which causes an increased tightening of band 44 about drum flange 21. This in turn causes pin 60 to drop by gravity free of the handle into the position illustrated in FIG. 4. Slowly the user allows handle 42 to reverse rotate. This loosens band 44 from around flange 21 of drum 12 to permit rotation of the drum and the uncoiling of cable 19 with housing 10 and the user descending from the window or roof to the ground. Any excessive rate of descent of the user will be prevented by centrifugal governor 31. By rotating handle 42 the user of the escape device cannot only selectively slow his descent but he can also stop his descent at any intermediate position between the window or roof and the ground.

Figure 4:
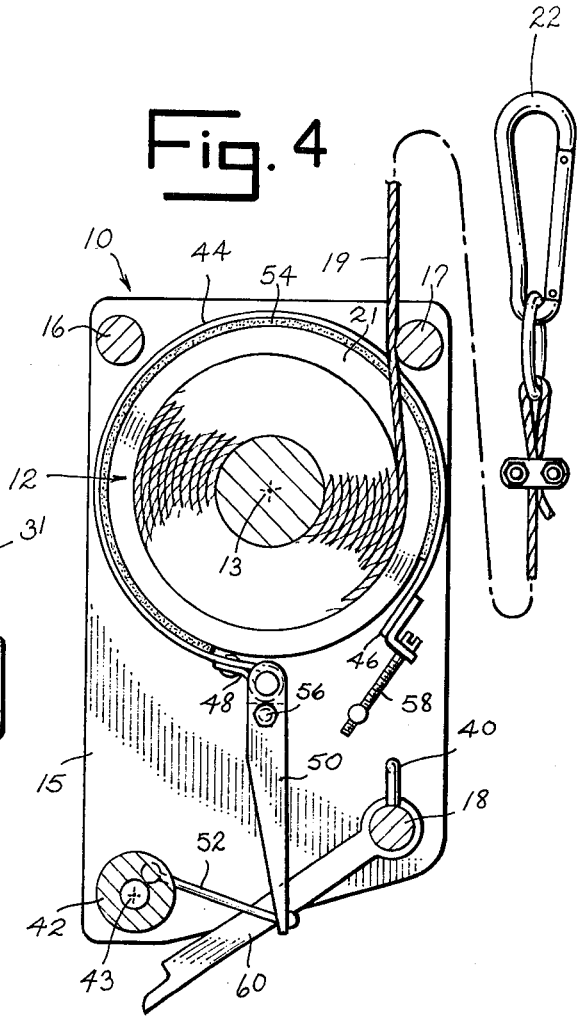
FIG. 4 is a sectional view taken along line 4—4 of FIG. 3.
Figure 5:
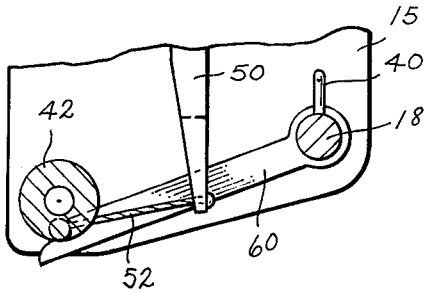
FIG. 5 is a fragmentary sectional view of the lock mechanism for the drum for the escape device shown in its locked position.

During use of the escape device cable 19 is fed between cross bar members 16 and 17, as best illustrated in FIG. 4, with such cross bar members serving as a guide during the uncoiling of the cable. A crank mechanism (not shown) can be provided for insertion into an interlocking bore formed in the end of the axle of drum 12 for the purpose of manually rotating the drum to rewind cable 19. Housing 10 and drum 12 may be formed from aluminum, magnesium or a similar high strength light weight material.

It is to be understood that the invention is not to be limited to the details above given but may be modified within the scope of the appended claims.

What I claim is:

1. An escape device comprising a housing, a drum journaled in said housing, a cable coiled about said drum and having a free end means for securement to a building part, a body support means for the escape device user carried by said housing, brake means carried by said housing and associated with said drum for retarding rotation of the drum during descent of the housing and the uncoiling of said cable from the drum with the free end means of the cable being secured to said building part and said body support carrying said user, said brake means including actuator means by which said user can selectively retard rotation of said drum during descent of the housing, said actuator means including a pivoted handle journaled to said housing, friction brake material, means for urging said brake material into contact with said drum upon movement of the handle to retard rotation of the drum, said drum including an annular braking surface, a band extending about said braking surface and having first and second ends, said brake material carried by said band adjacent said braking surface, said band having its first end anchored to said housing, said brake material urging means extending between said handle and band secured end to draw said band constrictively about said drum with said brake material contacting said braking surface when said handle is moved, said brake material urging means including a lever, means pivotally connecting said lever at a location intermediate the ends of the lever to said housing, one end of said lever connected to said band second end, connecting means extending between said lever other end and said handle, said housing including spaced side plates journaling said drum therebetween with said drum being rotatable about an axis, said handle extending between said side plates, means journaling the ends of said handle in said side plates for rotative movement of the handle about an axis generally paralleling the axis of rotation of said drum, said connecting means constituting flexible means having one end secured to said lever other end and having its opposite end secured to said handle offset from the axis of rotation of the handle for providing a pull on said lever during handle rotation to draw said band constrictively about said drum.

2. The escape device of claim 1 wherein the distance between the band second end connection to said lever and said lever pivot connecting means is less than the distance between said connecting means connection to said lever and said lever pivot connecting means whereby a mechanical advantage is provided said handle for causing said band to be drawn constrictively about said drum.

3. The escape device of claim 1 and lock means carried by said housing engageable with said handle for securing said handle in a rotated position with said band drawn constrictively about said drum to lock said drum against rotation when said escape device is not in use.

4. The escape device of claim 3 wherein said lock means is a pin, said handle including a catch means, means pivotally connecting said pin at one end to said housing for pivotal movement between an upper locked position and a lower release position, said pin when in its locked position engaging said catch means for locking said handle in its said rotated position, said handle having a second rotated position for automatically releasing said pin from said catch means to allow said pin to shift by gravity into its release position.

* * * * *